US005535454A

United States Patent [19]

Ryan

[11] Patent Number: 5,535,454

[45] Date of Patent: Jul. 16, 1996

[54] PROTECTIVE HELMET WITH HAIR ENTRAINING APERTURE

[76] Inventor: Pamela S. Ryan, 842 Park Place Dr., Mendota Heights, Minn. 55118

[21] Appl. No.: 283,789

[22] Filed: Aug. 1, 1994

[51] Int. Cl.[6] ..... A42B 3/00

[52] U.S. Cl. ..... 2/425; 2/209.7

[58] Field of Search ..... 2/410, 411, 422, 2/425, 414, 205, 209.11, 209.12, 209.13, 209.5, 209.7, 195.1, 209.3

[56] References Cited

U.S. PATENT DOCUMENTS

| | | | |
|---|---|---|---|
| 2,140,716 | 12/1938 | Pryale | 2/414 |
| 2,864,383 | 12/1958 | Jacks et al. | 132/46 |
| 3,766,565 | 10/1973 | Cozzens | 2/200 |
| 3,783,450 | 1/1974 | O'Connor | 2/3 R |
| 3,972,075 | 8/1976 | Alevras | 2/410 |
| 4,022,466 | 5/1977 | Kaiser | 273/1 B |
| 4,404,690 | 9/1983 | Farquharson | 2/420 |
| 4,599,752 | 7/1986 | Mitchell | 2/425 |
| 4,677,694 | 7/1987 | Crow | 2/9 |
| 4,776,324 | 10/1988 | Clarren | 2/410 |
| 4,885,806 | 12/1989 | Heller | 2/423 |
| 4,998,544 | 3/1991 | Obergfell | 132/212 |
| 5,003,640 | 4/1991 | Pizzacar | 2/199 |
| 5,170,509 | 12/1992 | Leopold | 2/199 |
| 5,239,705 | 8/1993 | Leopold | 2/209.13 |
| 5,289,591 | 3/1994 | Anderson | 2/411 |
| 5,321,854 | 6/1994 | Kronenberger | 2/209.7 |

*Primary Examiner*—Michael A. Neas

*Attorney, Agent, or Firm*—Merchant, Gould, Smith, Edell, Welter & Schmidt

[57] ABSTRACT

A protective helmet suitable for safe use by a person having long hair is disclosed. The helmet includes an outer dome-shaped shell of impact-resistant material configured to fit on the head of a wearer. A liner affixed to the inside of the shell snugly positions the helmet on the head and dissipates impact forces received by the outer shell. An aperture formed through the rear portion of the helmet is sized to enable the wearer's hair to be gathered and entrained therethrough, but is sized small enough to prevent harmful impact penetration of an object such as a ball, hockey puck or the like with the wearer's head.

16 Claims, 2 Drawing Sheets

FIG. 1
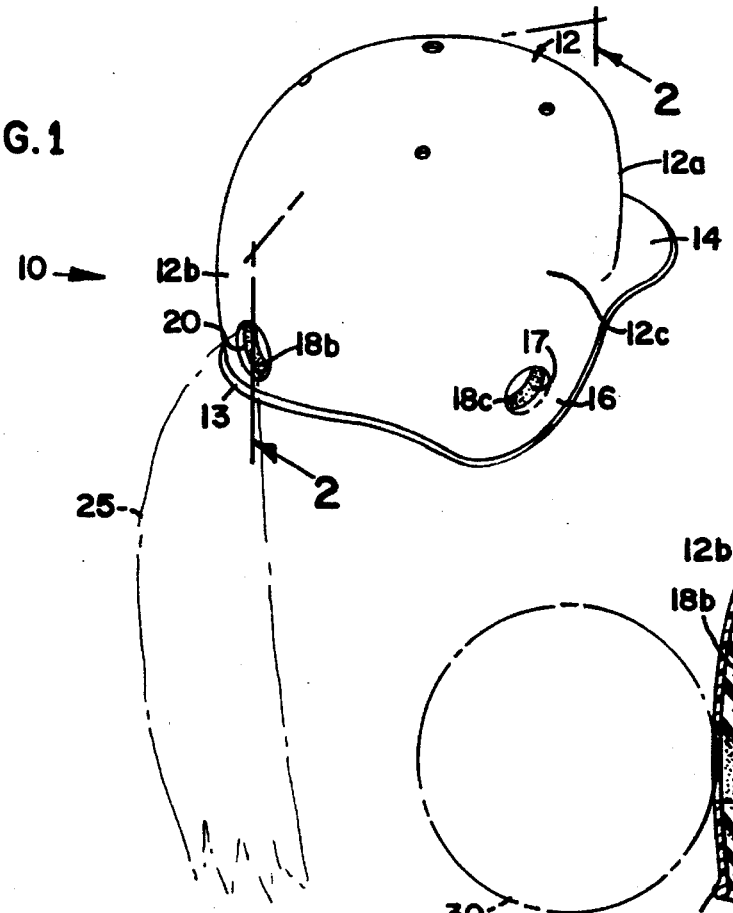
FIG. 3
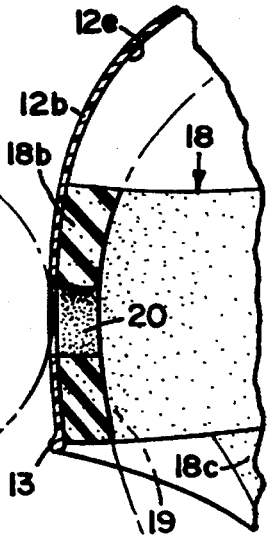
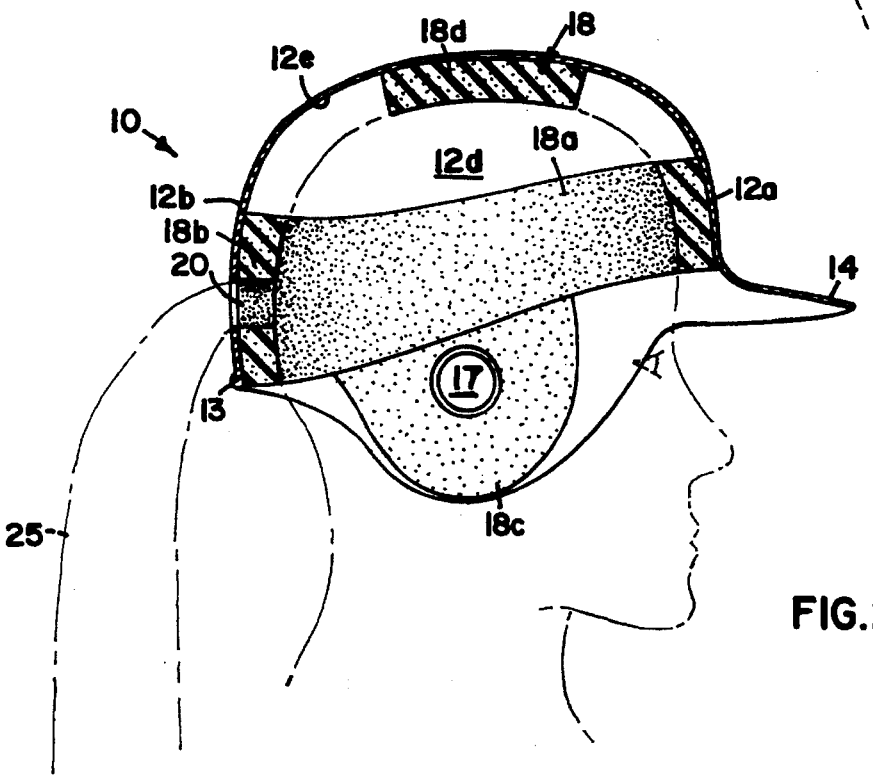
FIG. 2

FIG. 4A
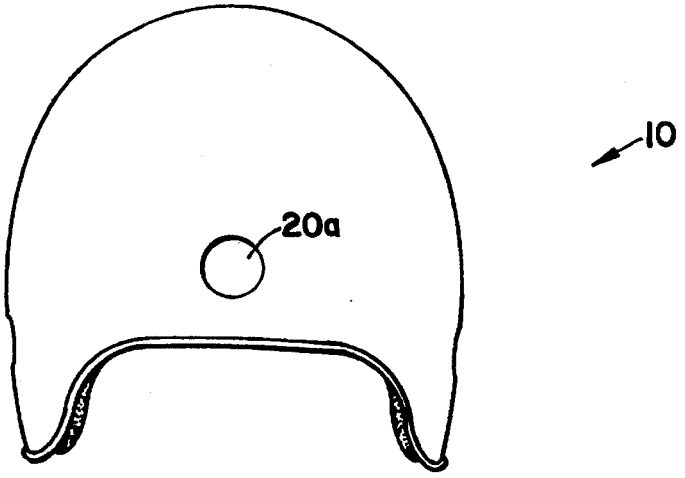
FIG.4B
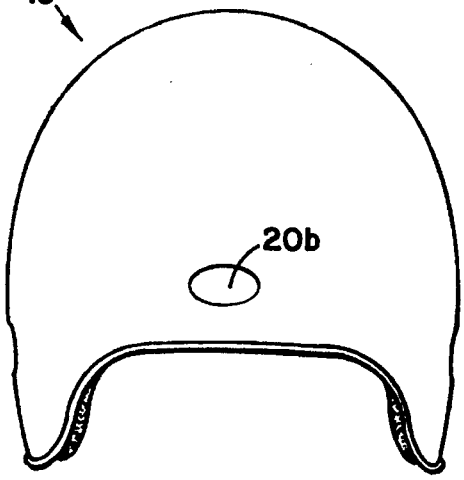
FIG.4C
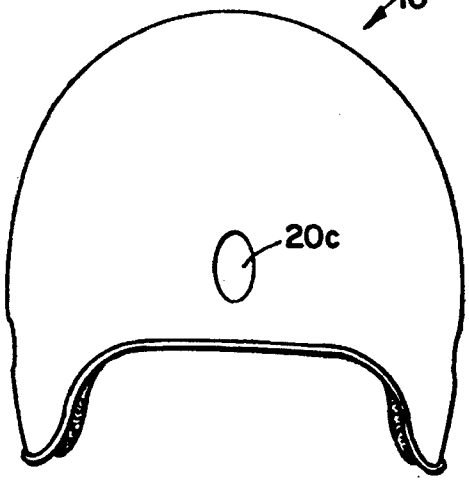
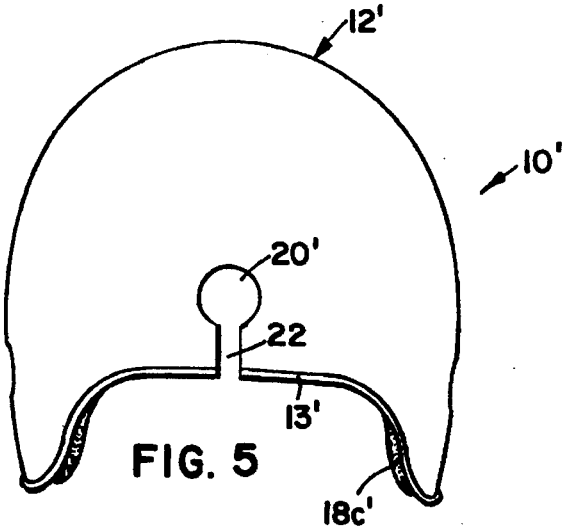
FIG. 5

PROTECTIVE HELMET WITH HAIR ENTRAINING APERTURE

FIELD OF THE INVENTION

This invention relates generally to protective sportswear, and more particularly to an improved protective helmet.

BACKGROUND OF THE INVENTION

Protective helmets for use in sports such as baseball, softball, hockey and football are generally required to be worn by players, at least in the sports association sanctioned youth and amateur sporting programs. The primary function of such helmets is to protect the player from impact blows to the head which could cause severe injury. For example, in the sports of baseball or softball it is not uncommon for a ball in play to be pitched, thrown or batted in the 50 to 90 mile per hour range. In ice hockey, the solid hockey puck can travel at speeds in excess of 100 miles per hour. It is important in such sports for the player to be protected against the danger of such flying objects and against other forms of physical contact to the head which may occur during course of play during the game.

Protective head gear helmets of varied configurations particularly adapted for different sports, are known in the art. Most such helmets have an outer protective shell of rigid impact-resistant plastic material with an internal liner or padding configured to support the shell on the player's head such that blows or impact forces that impinge on the plastic shell are virtually dissipated by the plastic and associated lining, to a level that is safe for the wearer. Most such protective head gear must meet industry or sporting association minimal safety standards for specific sports such as those promulgated by the National Operating Committee on Standards in Athletic Equipment (i.e., NOCSAE).

A number of such helmets of varied styles and configurations are known. The primary concern of a helmet is to protect the head of the wearer or player against head injuries. As such, their design has been typically safety-driven, with little consideration being given to the comfort or unique physical differences of their wearers. Traditionally, such helmets have been designed for players having shorter hairstyles and do not readily conform to the head of a player having longer hair. Such players have had to generally resort to braiding their hair or otherwise arranging their hair on their head so as to somehow fit within the helmet. For example, players having hair arranged in a ponytail or braid have had to push or otherwise position their excess hair within the helmet so as to fit between the helmet's liner parts or inner padding. In the haste of game play, such goal is often not achieved and the wearer's excess hair within the helmet can cause the helmet to "ride" up on the hair, thus mispositioning the helmet on the player's head in an unsafe, and unstable manner. Alternatively, such hair could be pulled down along the back of the player's neck and sandwiched between the padding or liner material at the back of the helmet and the back of the player's head. This technique is generally not possible because of the snug fitting design of the helmet. However, if employed, the technique is still not advisable since the thickness of the gathered hair can cause the helmet to slide on the hair or to be otherwise cocked or misaligned on the player's head, thereby potentially reducing the safety effectiveness of the helmet and making it more susceptible to being dislodged from the player's head during strenuous motion, running or upon contact.

In the past, there has been little incentive to provide "specialized" helmets for the long haired athletes since the number of such athletes vs. those having shorter hair for which the conventional helmets were designed was proportionately small. However, with the more active participation of women in athletics and the sanctioning of women leagues in virtually all sports and with the relatively recent acceptance of longer hair styles for men athletes, the need for safe and stable protective helmets for athletes having long hair has become much more of an issue. Further, with the increased awareness of safety and potential liability of those not providing safe head wear protection for all athletes participating in a sport, the issue of providing protective helmets providing a high degree of safety to athletes having longer hair has become more acute.

It has been fashionable for long-haired players and wearers of softwalled baseball or painter's caps of the adjustable type to pull their braided or ponytailed hair through the relatively large adjustable opening in the back of the cap. However, such caps offer no safety protection to the wearer and are not designed as safety or protective helmets.

The present invention addresses the need for a safety helmet, and particularly for a safety sports helmet for wearers, and in particular for athletes having long hair, in a manner that does not compromise the safety features of the helmet. In particular, the invention provides a protective safety helmet that can be worn with equal safety by those having long or short hair, and which when worn by those having long hair fits in the same snug and proper protective position on the wearer's head as it does on one having short hair.

SUMMARY OF THE INVENTION

The present invention provides a impact-resistant helmet configuration that can be designed to accommodate protective helmet designs for virtually any contact sport, and which is particularly designed for athletes with long hair. While the preferred application for the present invention is for its use in the configuration of a batter's helmet for baseball or softball, the invention is not limited to these sports. For example, the principles of the invention apply equally well to the construction of impact protective helmets for any contact sport or for sports including fast moving objects such as ice hockey, lacrosse, field hockey, and the like, in which a long-haired player is allowed to participate in the sport with his or her hair extending externally of the helmet. Further, the principles of the invention are not limited to the use in contact sports or sports at all, but could also be applied simply to protective helmets in general such as might be used by cyclists or in the construction industry.

Therefore, according to one aspect of the invention, there is provided a protective helmet adapted to be worn on the human head, comprising:

a. an outer domed shell of rigid, impact-resistant material configured to fit on the head of a wearer, wherein the shell defines front, rear and oppositely disposed sides cooperatively defining an inner surface that addresses the wearer's head;

b. liner means cooperatively connected to the inner surface of the domed shell for snugly engaging the wearer's head and for providing an impact-absorption cushion between the outer shell and the wearer's head; and c. wherein the rear side of the helmet shell defines a hair entraining aperture formed therethrough which is sized and configured large enough to allow the wearer's hair to be entrained therethrough, but is small enough to prevent penetration on impact therewith of an object moving relative to the helmet and against which the helmet was designed to protect.

According to yet a further aspect of the invention, there is provided such a protective helmet suitable for the sport of baseball, wherein such helmet includes a front visor and one or more protective ear portions extending from the outer domed shell. According to yet another aspect of the invention, there is provided such a helmet wherein the aperture continuously extends upward from and through a lower rear edge of the helmet such that the wearer's hair can be slid upwardly through the lower aperture and into an entrained position.

According to yet another aspect of the invention, there is provided a protective helmet of a type suitable for use in a sport that uses a ball having a specified diameter, comprising:

a. a generally dome-shaped impact resistant protective skull portion contoured to define an inner surface configured for overlying a human head and having oppositely disposed front and rear surfaces and oppositely disposed sides intermediate the front and rear surfaces;

b. a visor portion extending outwardly from said front surface;

c. foam padding mounted to the inner surface of the skull portion and selectively positioned for snugly engaging a wearer's head for positioning said skull portion relative to the head and for cushioning the wearer's head from impact forces received by the protective skull portion; and d. wherein the skull portion defines a hair entraining aperture formed through the rear surface thereof which is sized and configured large enough to allow a gathered length of the wearer's hair to be entrained therethrough but having a maximum width significantly smaller than the specified diameter of the ball for preventing penetrable impact of the ball with the wearer's head through said aperture.

While the present invention will be described in association with a preferred embodiment application for its use with a batter's helmet in the sports of baseball or softball, it will be understood that the invention is not to be limited by strict association with the sports of baseball or softball. Further, as used hereafter in the description of the invention, the term "baseball" is intended to be used in its broad generic sense to describe the sport in general, and necessarily includes the more precisely defined sports of "baseball" (using a small hard ball) and "softball" (using a larger, softer ball).

Further, while the preferred embodiment of the invention will be described with regard to a particular known style of batter's helmet, of unitary construction, it will be understood that the invention is not necessarily limited to any particular style or method of manufacture of a protective helmet—but is to be broadly interpreted to encompass all different styles and forms of construction of protective helmets. For example, hockey helmets are often constructed in multiple segments (i.e, not of unified construction).

The principles of this invention would apply just as much to such nonunified construction as to the batter's helmet unified construction. Further, while the invention will be described with respect to helmets having a particular type of impact-resistant plastic material, the invention is not to be limited to the use of such plastic material for construction of the outer impact-receiving shell portion of the helmet. Similarly, while the preferred embodiment of the batter's helmet incorporating the invention uses a liner of foam padding material, the invention certainly is not limited to the use of such foam padding, but would apply to any type of impact force dissipating material or equivalent liner construction. As will become evident upon a more detailed description of the invention, the principles of the invention apply to all shapes and configurations of hair entraining apertures that otherwise meet the size and configuration safety aspects required by the invention. These and other aspects of the invention will become more apparent from the following more detailed description of the invention.

BRIEF DESCRIPTION OF THE DRAWING

Referring to the Drawing, wherein like numerals represent like parts throughout the several views:

FIG. 1 is a perspective view as it would appear from the rear and side of a batter's helmet, configured according to the principles of the present invention;

FIG. 2 is a cross-sectional view taken along the Line 2—2 of FIG. 1, illustrating the relationship between the outer shell and inner lining portions of the helmet of FIG. 1;

FIG. 3 is an enlarged fragmentary portion of the helmet configuration of FIG. 2, shown as it might appear when impacted by a ball or cylindrical object directly aligned to impact squarely with the aperture in the rear of the helmet;

FIG. **4*a* is a rear elevational view of the helmet of FIG. 1**, illustrating a first configuration of the aperture in the rear of the helmet;

FIG. **4*b* is a rear elevational view of the helmet of FIG. 1**, illustrating a second configuration of the aperture in the rear of the helmet;

FIG. **4*c* is a rear elevational view of the helmet of FIG. 1, illustrating a third configuration of the aperture in the rear of the helmet; and FIG. 5 is a rear elevational view of a second embodiment of a batter's helmet of the general type illustrated in FIG. 1**, illustrating a second embodiment of an aperture in the rear of the helmet, configured according to the principles of this invention.

DETAILED DESCRIPTION OF THE PREFERRED EMBODIMENT

This invention provides a protective helmet for sporting or other uses, which accommodates the long hair of its wearer, and which can also be used for its intended safety purposes by those not having such long hair. Referring to the figures, FIG. 1 illustrates batter's helmet of the type typically used for the sport of baseball, which incorporates the principles of this invention. Referring thereto, the batter's helmet, generally designated by the numeral 10, is of conventional type, having an upper curved domed portion 12 which fits over and protects a major portion of the wearer's head, a front visor portion 14 and one or more side ear flaps 16 which depend downwardly from the upper dome portion for protecting the batter's ears. The ear flaps typically include an aperture or opening 17 for sound transmission. Such helmets, when constructed with two side ear flaps, can be used for either left-handed or right-handed batters; however, the helmet could equally well be constructed with only either a left or a right side ear flap, in which case such helmets would respectively be designated for right-handed or left-handed batters respectively. Alternatively, the helmet may be constructed entirely without side ear flaps. Similarly, while the baseball helmet illustrated includes a sun visor 14, the helmet could be constructed with no visor at all, as may be the case for a catcher's helmet. It will be understood that all variations of such helmets are intended to be covered within the broad scope of this invention.

The helmet dome portion, visor portion and ear side flaps collectively comprise the outer shell material of the helmet, and are preferably constructed of a high-impact plastic material of a type suitable for withstanding the impact forces peculiar to the particular sport with which the helmet is used and over a wide temperature range, without shattering, cracking or otherwise unsafely breaking. For example, in baseball, the primary impact force for which the batter's helmet is designed to be safeguarded against, is the impact of a pitched ball. The specific strength, thickness, and other parameters for construction of the helmet shell are generally dictated by the safety standards imposed by the particular industry or sporting association that determines such standards for the sport with which the helmet will be used. For example, in the sport of baseball, the National Operating Committee on Standards in Athletic Equipment (NOCSAE) has developed a procedure for testing baseballs and baseball batter's helmets and the minimum requirements to be met under each test. Such standards generally include specific impact tests which the helmet must safely endure under various temperatures and when subjected to impact from specified angles by balls projected at various speeds and from various distances. It is typical for such standards to require ball impact speeds of from 60 to 100 miles per hour. To the extent such standards or the procedures dictated therein are required for a more complete understanding of this invention, the reader is referred to such standards, which are hereby incorporated by reference. Such standards generally also dictate the "size" of the helmet shell with regard to that amount of surface area of the player's head, and the specific portions thereof, which must be protected in order to pass certification under the test standards. The helmet illustrated in FIG. 1, is typical of the configuration used for the sport of baseball. It will be understood, however, that variations thereof will occur in the illustrated configuration due to different levels and age participation in the sport. In general, the outer shell material comprises a hard, impact-resistant, shatterproof plastic-type material, well-known in the art.

The outer dome portion 12 of the helmet generally includes front and back portions 12*a* and 12*b* respectively, and oppositely disposed side portions 12*c* and 12*d*, which collectively cooperatively define an internal dome-shaped shell cavity 12*e* configured to fit over the batter's head in the manner of conventional batting helmets. The outer dome or skull shell portion 12 is sized slightly larger than the wearer's head size and includes an appropriate inner liner 18 connected to the inside of the shell cavity 12*e*. In the preferred embodiment illustrated, the liner comprises a dense foam padding material of closed cell foam material which directly contacts the wearer's head. The liner properly positions and supports the helmet on the wearer's head and dissipates impact forces delivered to the outer shell. Typically such padding includes an annular band or ring 18*a* of padding which peripherally extends around the inner portion of the dome cavity just above the ear holes; an upwardly extending portion of padding 18*b* affixed to the inner rear portion of the dome cavity; circular or annular portions 18*c* affixed to the inner surfaces of the side ear flaps; and a circular or geometrically shaped pad 18*d* affixed to the top portion of the dome cavity. The padding materials 18 are cooperatively sized in cooperation with the size and shape of the upper dome portion 12 of the helmet such that the padding snugly contacts the wearer's head to assure a snug fit of the helmet on the head when in operative use.

The liner padding 18 is of a suitable material and thickness that safely dissipates impact force. Appropriate padding material can be either of a crushable material such as cellular polystyrene, or suitable noncrushing elastomers having a relatively low rate of elasticity to prevent the batter's head from rebounding within the helmet due to compression and sudden expansion of the elastomeric material. The function of the padding is to essentially isolate the external shell portions of the helmet from the batter's cranium and to dissipate impact forces imparted to the outer shell of the helmet, to levels which are safe for transmission to the batter's cranium.

The above-described helmet is typical of a batter's helmet known in the art. It will be understood that such helmets can also be adapted to include additional protective extensions or flaps, face masks, retaining straps, eye guards or the like, in manners well-known in the art.

Referring to FIG. 1, the rear portion of the outer dome or shell 12 defines an aperture 20 formed therethrough which extends through the outer shell and back padding material 18b and into the inner cavity 12*e* of the helmet. The aperture 20 enables generally unobstructed access therethrough between the inner cavity 12*e* and the environment external of the helmet. The aperture 20 is sized and configured to enable a wearer's hair 25 which may be gathered together in the nature of a braid or a ponytail to be entrained and pulled or pushed through the aperture, as indicated in phantom lines in FIG. 1. The aperture 20 must be significantly large enough to enable relative ease of placement of the wearer's hair therethrough, but must be sized small enough in its "widest" dimension to prevent the ball or flying object in play (or other object against which protection is being sought) from penetrating far enough into the inner cavity 12*e* so as to harmfully engage the wearer's head, when subjected to an impact force as may be received from a pitched or hit ball. In other words, the actual widest dimension and size configuration of the aperture 20 must be selected in cooperation with the diameter of the baseball or other ball or item (such as a hockey puck) which is used in the sport with which the helmet is used, to prevent injury to the wearer's head by excessive penetration through the aperture. As used herein, the term "width" when referring to the aperture 20 is being used to designate the largest dimension across an "open" portion of the aperture, through which an object could penetrate, and is not intended to be limiting by implying any particular reference to a "direction" (i.e., "width," "length," "height," etc.). In addition to the above two size considerations for the aperture, the aperture should be configured and sized adequately to entrain the wearer's hair in a manner such that the aperture does not catch or pull on the entrained hair. Rather, the hair should slide relatively freely within the aperture.

In the preferred embodiment of the invention, wherein a generally circular aperture 20 is illustrated, an aperture having a diameter of from about 0.75 inches to 2.0 inches, and more preferably from about 1.5 inches to 1.75 inches is preferred. Such aperture size enables the hair of a wearer to be easily slidably entrained therethrough, while adequately protecting against excessive penetration of a ball through the aperture, which would cause engagement thereof under impact with the wearer's head. FIG. 3 illustrates the situation which might occur when a ball or hockey puck or the like squarely impacts the helmet in direct alignment with the aperture 20. FIG. 3 illustrates the compression that occurs to the protective padding 18*b* at the back of the helmet as a result of such impact, and illustrates that even with such padding compression, the ball or flying object 30 still cannot penetrate the aperture 20 far enough to harmfully engage the wearer's head or cranium.

While a preferred configuration for the aperture 20 is a round hole as indicated in FIG. 4*a*, the invention certainly contemplates noncircular aperture configurations of infinitely different configurations. Two of such alternate possibilities are indicated in FIGS. 4*b* and 4*c*, wherein the apertures 20*b* and 20*c* are indicated as generally oval in shape and at varied angular configurations with respect to the rear portion of the helmet shell. Other, nonarcuate aperture shapes such as rectangular, triangular or other geometric shapes are possible as well. Regardless of the actual shape or configuration of the apertures, the maximum aperture "width," however, must still be small enough to prevent excessive penetration of the flying object or other device from which the wearer's head is desired to be protected. Further, the shape and configuration of the aperture 20 selected, must be structurally sound such that a direct or square impact from the flying object against which protection is being sought will not cause breakage or structural weakening of the outer helmet shell material.

A second embodiment of a batter's helmet incorporating the principles of this invention is illustrated in FIG. 5. Referring thereto, wherein parts identical to those of the helmet previously described with respect to FIGS. 1–4 are illustrated by the same numerical designation followed by a prime (') notation. The aperture 20' in the rear portion of the helmet 12' is illustrated as downwardly extending along a slot or passageway configuration 22. The slot 22 extends from the primary aperture 20' to and through the lower back edge 13 of the helmet. In this embodiment of the invention, the internal padding 18*b'* at the back of the helmet is configured in a manner such that an unobstructed passageway is formed from the lower back edge 13 of the helmet 10' which extends upward through the slot 22 and into the enlarged aperture 20' such that a wearer of the helmet 10' can slide her or his ponytail or braided hair upward through the slot 22 for entrainment through and by the primary aperture 20', in manner previously discussed with respect to the first embodiment. It will be understood by those skilled in the art, that the size, shape and configuration of the aperture 20' as well as that of the slot 22 may assume any number of different shapes and configurations, but that they are restrained singly and in combination by the design constraint that the flying object against which protection is being sought must not be able to harmfully penetrate therethrough for engagement with the wearer's head or cranium.

From the foregoing, it will be appreciated that a user-friendly helmet construction particularly adapted for use by wearer's having long hair, but also which is safe for use in general by those having short hair, has been disclosed. The invention enables a person having long hair to position such excess hair through and outside of the helmet in a manner that permits the helmet to otherwise snugly and safely fit down on top of and around the wearer's head in the manner for which it was originally designed. The absence of excess hair within the helmet allows the helmet to maintain its "stability" on the wearer's head during running and during other abrupt motion actions. The invention also reduces the tendency for the helmet to "float" on the excess hair within the helmet, which is a common problem with existing helmet designs. While the invention has been described with respect to a particular preferred embodiment thereof, and with respect to specific types of materials used in the construction thereof and with respect to specific aperture configurations, it will be understood by those skilled in the art that the invention is not to be limited in any manner by such described specifics. The preferred embodiments have been described to illustrate clear examples of how the principles of this invention can be implemented for use with a sporting helmet. All alternatives and modifications of the foregoing are intended to be covered within the broad scope of the appended claims.

What is claimed is:

1. A protective helmet of a type suitable for use in a sport that uses a ball having a specified diameter, comprising:

a. a generally dome-shaped impact resistant protective skull portion contoured to define an inner surface configured for protectively overlying a human head, having oppositely disposed front and rear surfaces and oppositely disposed sides intermediate said front and rear surfaces, said rear surface defining a lower rear edge;

b. a visor portion extending outwardly from said front surface;

c. foam padding mounted to the inner surface of said skull portion and selectively positioned for snugly engaging a wearer's head for positioning said skull portion relative to the head and for cushioning the wearer's head from impact forces received by the protective skull portion; and d. said skull portion defining a hair entraining aperture formed through said rear surface thereof, said aperture being sized and configured large enough to allow a gathered length of the wearer's hair to be entrained therethrough but having a maximum width significantly smaller than the specified diameter of the ball for preventing penetrable impact of the ball with the wearer's head through said aperture; and wherein said hair entraining aperture extends continuously upward from and through said lower rear edge such that the wearer's hair can be slid upwardly into said aperture from said lower rear edge.

2. The helmet as recited in claim 1, wherein said foam padding comprises closed cell foam material.

3. The helmet as recited in claim 2, wherein said foam padding surrounds said hair entraining aperture on said inner surface of said skull portion.

4. The helmet as recited in claim 1, wherein at least one of said sides of said skull portion extends generally vertically downward from the dome-shaped portion to form a protective ear covering.

5. The helmet as recited in claim 1, wherein said hair entraining aperture is positioned in said rear surface of said skull portion such that it is entirely encircled by protective material of said skull portion.

6. The helmet as recited in claim 1, wherein said aperture is characterized by an arcuately shaped enlarged opening upwardly spaced from said lower rear edge and a slot-like passageway continuously extending from and through said lower rear edge to said arcuately shaped enlarged opening.

7. The helmet of claim 6, wherein said arcuately shaped enlarged opening portion of said hair entraining aperture is generally circular.

8. The helmet as recited in claim 7, wherein the width of said enlarged opening portion of said aperture is from about 0.75 inches to 2.0 inches.

9. The helmet as recited in claim 8, wherein the width of said enlarged opening portion of said aperture is from about 1.5 to 1.75 inches.

10. The helmet as recited in claim 1, wherein said skull portion comprises hard impact-resistant plastic material.

11. A protective helmet adapted to be worn on a human head and of a type used to protect the head against damaging impact from a specified object, comprising:

a. an outer domed shell of rigid, impact-resistant material configured to fit on a human head, said shell defining front, rear and oppositely disposed sides cooperatively defining an inner surface that cooperatively addresses the head and a lower rear edge, said front surface being positioned relative to a forehead portion of the head;

b. liner means operatively connected to said inner surface of said shell for snugly engaging the head and for providing an impact absorption cushion between said shell and the head; and c. said rear side of said shell defining an aperture formed therethrough and having a portion thereof extending to and through said lower rear edge such that said hair can be upwardly slid into said aperture from said lower edge, said aperture being sized and configured large enough to entrain a gathered length of hair from the head therethrough but small enough to prevent penetration of the specified object therethrough to a depth that would cause the object to contact the head.

12. The protective helmet as recited in claim 11, wherein said helmet further includes a visor extending forwardly from said shell from said front side thereof.

13. The protective helmet as recited in claim 11, further including at least one protective ear portion extending downwardly from one of said side portions of said shell.

14. The protective helmet of claim 11, wherein the specified object is a ball.

15. The protective helmet of claim 14, wherein said impact-resistant material of said shell is suitable for withstanding impact forces from a ball traveling at speeds of greater than or equal to 60 miles per hour.

16. The protective helmet of claim 11, wherein the specified object is a hard disk shaped object.

* * * * *